US008235670B2

(12) United States Patent
Morrison et al.

(10) Patent No.: US 8,235,670 B2
(45) Date of Patent: Aug. 7, 2012

(54) INTERLOCKED CMC AIRFOIL

(75) Inventors: Jay A. Morrison, Oviedo, FL (US); Anthony L. Schiavo, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 655 days.

(21) Appl. No.: 12/486,180

(22) Filed: Jun. 17, 2009

(65) Prior Publication Data

US 2010/0322760 A1 Dec. 23, 2010

(51) Int. Cl.
*F01D 5/14* (2006.01)

(52) U.S. Cl. ..... 416/223 A; 29/889.72

(58) Field of Classification Search ..... 416/212 A, 416/224, 232, 223 A, 241 B; 29/889.72
See application file for complete search history.

(56) References Cited

U.S. PATENT DOCUMENTS

| | | | |
|---|---|---|---|
| 6,514,046 | B1 | 2/2003 | Morrison et al. |
| 7,066,717 | B2 | 6/2006 | Morrison et al. |
| 7,316,539 | B2 | 1/2008 | Campbell |
| 2008/0203236 | A1 | 8/2008 | Mazzola et al. |

FOREIGN PATENT DOCUMENTS

| | | | |
|---|---|---|---|
| JP | 54010806 A | * | 1/1979 |
| JP | 59079008 A | * | 5/1984 |

* cited by examiner

*Primary Examiner* — Richard Edgar

(57) ABSTRACT

A ceramic matrix composite (CMC) airfoil assembled from a pressure side wall (42) and a suction side wall (52) joined by interlocking joints (18, 19) at the leading and trailing edges (22, 24) of the airfoil to produce a tapered thin trailing edge. The trailing edge (24) is thinner than a combined thicknesses of the airfoil walls (42, 52). One or both of the interlocking joints (18, 19) may be formed to allow only a single direction of assembly, as exemplified by a dovetail joint. Each joint (18, 19) includes keys (44F, 54F, 56F, 46F) on one side and respective keyways (44K, 54K, 56K, 46K) on the other side. Each keyway may have a ramp (45) that eliminates indents in the airfoil outer surface that would otherwise result from the joint.

20 Claims, 7 Drawing Sheets

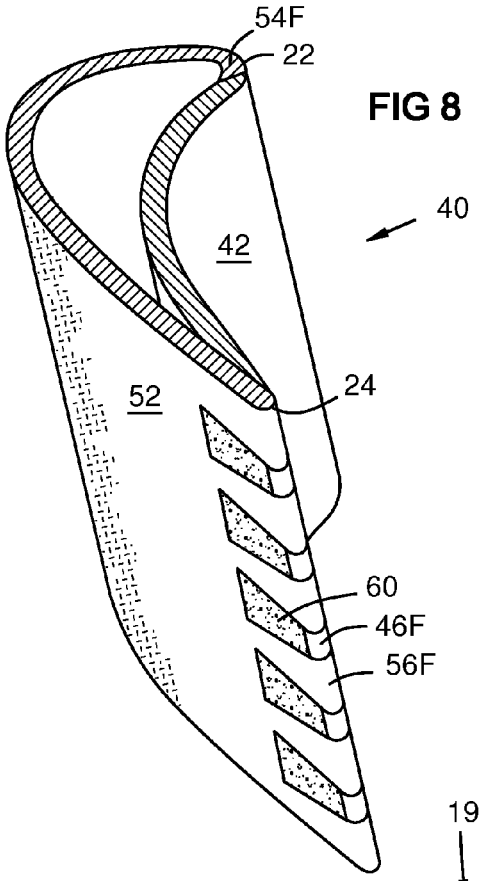
FIG 8
FIG 9
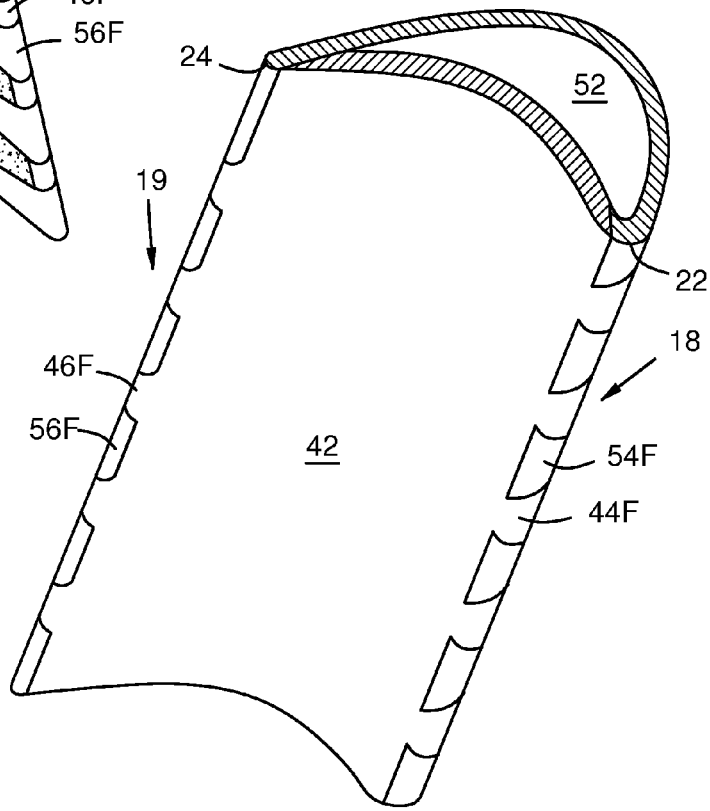

INTERLOCKED CMC AIRFOIL

FIELD OF THE INVENTION

This invention relates to ceramic matrix composite (CMC) airfoil structures, and particularly to gas turbine vanes.

BACKGROUND OF THE INVENTION

Ceramic matrix composites (CMC) are used for components in high temperature environments, such in gas turbine engines. Oxide based CMC is typically formed by combining ceramic fibers with a ceramic matrix, and heating the combined material to a sintering temperature. The fibers add tensile strength in the directions of the fibers. The resulting material has a higher operating temperature range than metal, and can be optimized for strength by fiber orientations and layering.

A curved CMC wall has a minimum radius of curvature if any of the ceramic fibers wrap around the curve, due to limited flexibility of the fibers. This presents problems in CMC airfoil fabrication, because an airfoil preferably has a thin trailing edge. FIG. 1 shows an airfoil with a leading edge 22, a trailing edge 24, a pressure side 26, a suction side 28, a ceramic matrix material 24, and multiple ceramic fiber layers 36. The minimum radius of curvature of the CMC fiber is used for the outermost layer at the trailing edge to form a thin trailing edge 24. This minimum radius also applies to the inner fiber layers, which creates separations and voids 38 between the layers.

FIG. 2 shows a known airfoil design in which the CMC trailing edge 24 has an outer radius that is concentric with the inner layers. Only the innermost layer is limited by the minimum bending radius. This provides uniform layer spacing around the trailing edge 24 without voids. However, an additional trailing edge member 32, made of metal for example, must be added to provide a thin final trailing edge 33.

Vane airfoils in gas turbines are often hollow and internally pressurized with a coolant gas such as air or steam. This pressure causes a stress concentration at the inner curve 25 of the trailing edge. For laminated constructions, this internal pressure results in an interlaminar tensile stress concentrated at the inner radius of the trailing edge, which tends to be a design-limiting feature. Gas pressures inside and outside of the airfoil vary with engine cycles, causing cyclic stress at the trailing edge.

BRIEF DESCRIPTION OF THE DRAWINGS

The invention is explained in the following description in view of the drawings that show:

FIG. 8 is perspective rear view of an airfoil assembled per FIG. 7.

FIG. 9 is a perspective pressure side view of an airfoil assembled per FIG. 7.

DETAILED DESCRIPTION OF THE INVENTION

The inventors have recognized that a thin CMC trailing edge can be achieved by forming an airfoil in two parts, a pressure side wall part and a suction side wall part, tapering the trailing edges of the two parts and bonding them together. However, the resulting trailing edge joint might not be sufficiently resistant to separation and delamination from the stresses previously described, so they conceived the following interlocking airfoil assembly.

Figure 1:
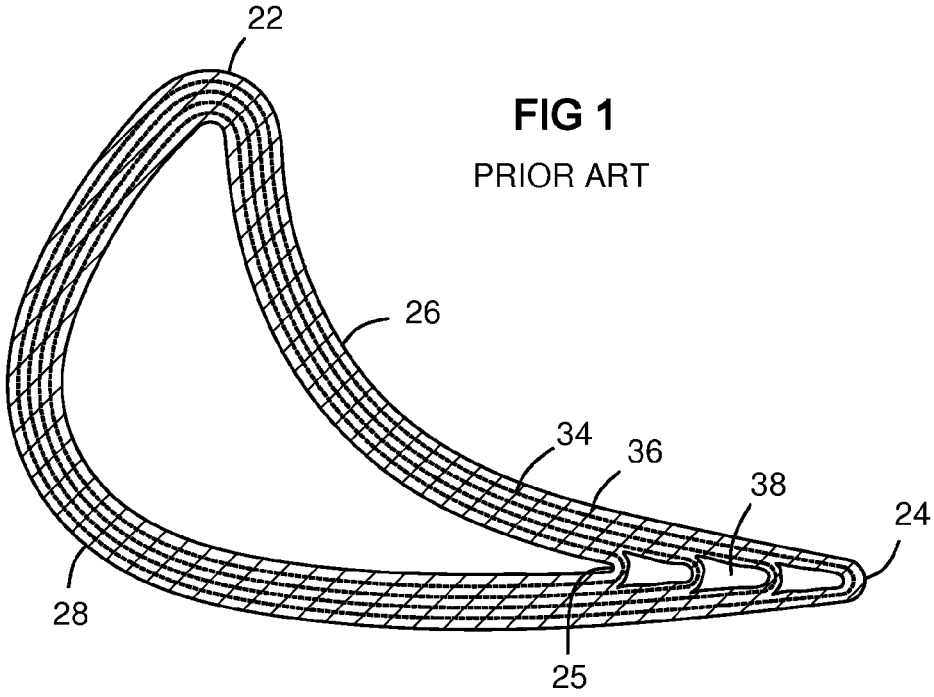
FIG 1 PRIOR ART
FIG. 1 illustrates a prior art problem that occurs in attempting to form a CMC airfoil with a thin trailing edge by ceramic fiber layer wrapping.
Figure 2:
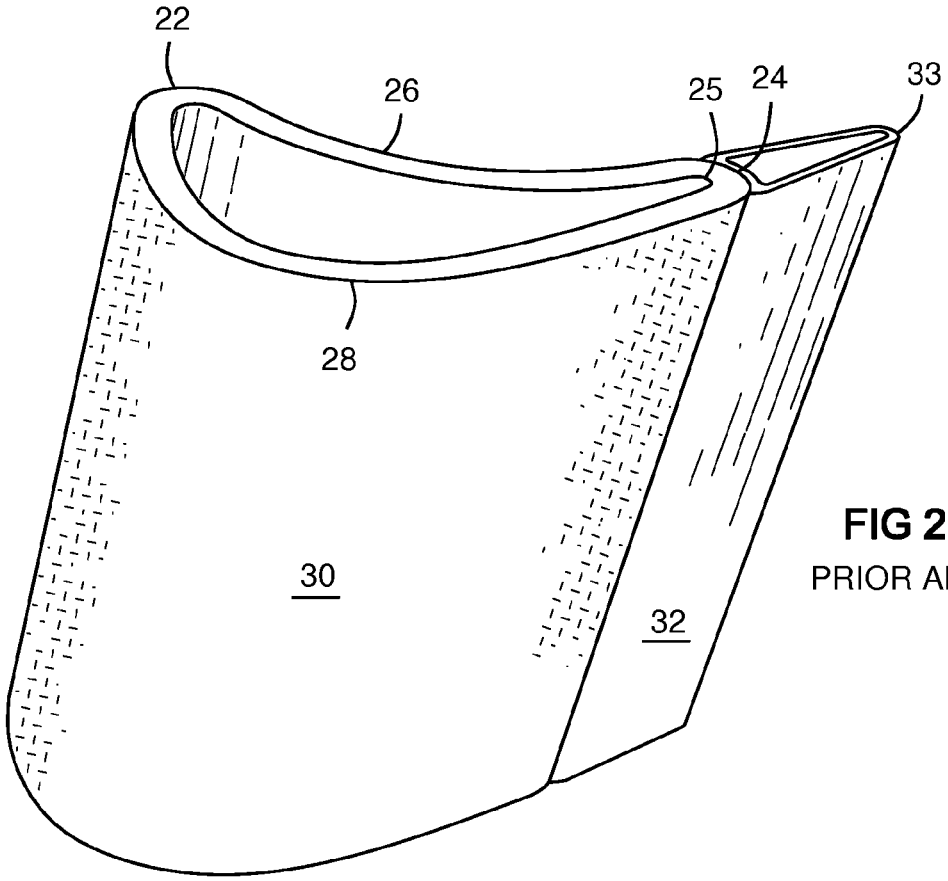
FIG 2 PRIOR ART
FIG. 2 shows a prior solution to the problem of FIG. 1 by adding a metal trailing edge.
Figure 3:
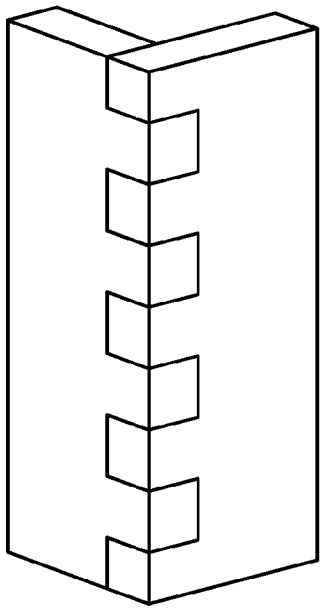
FIG 3 PRIOR ART
FIG. 3 shows a finger joint as known in cabinetry.
Figure 4:
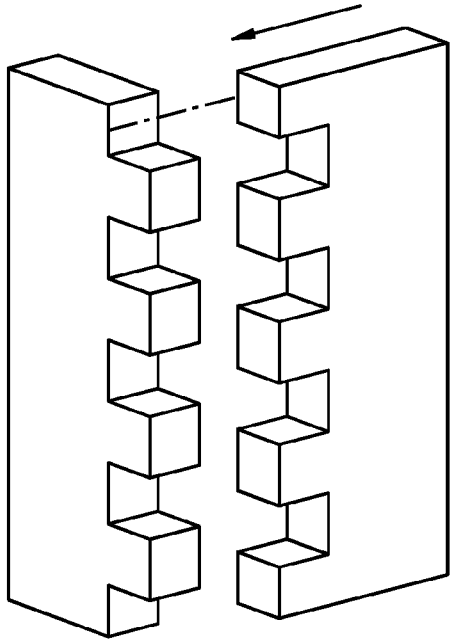
FIG 4 PRIOR ART
FIG. 4 shows an assembly direction of the finger joint of FIG. 3.
Figure 5:
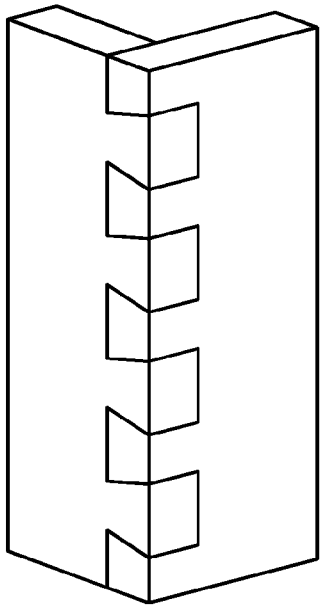
FIG 5 PRIOR ART
FIG. 5 shows a dovetail joint as known in cabinetry.
Figure 6:
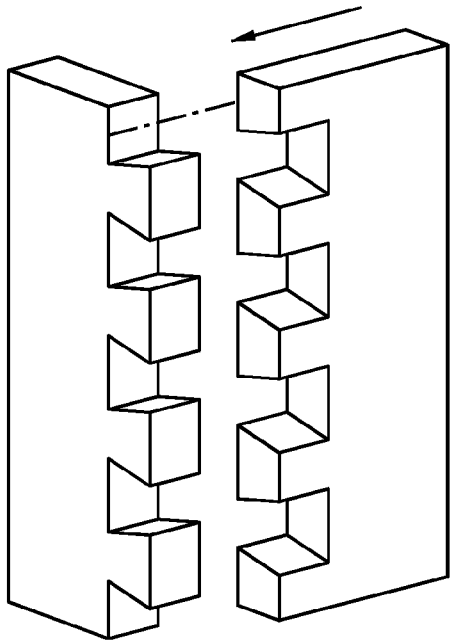
FIG 6 PRIOR ART
FIG. 6 shows the only assembly direction of the dovetail joint of FIG. 5.

FIGS. 3 and 4 show a finger joint known in cabinet making. This joint interlocks and prevents relative vertical movement of the two joined parts. It also provides an increased bonding surface with very strong separation resistance. FIGS. 5 and 6 show a dovetail joint known in cabinet-making. This joint can only be assembled along a single direction shown by the arrow, so it prevents separation in all directions except the reverse of the assembly direction. However, application of these types of woodworking joints to an airfoil is not straightforward because, unlike in woodworking applications, the pressure and suction side walls meet at a narrow angle at the trailing edge, they must merge into a thin edge, and the joint must form an aerodynamically smooth outer surface.

FIGS. 7-11 show an airfoil 40 according to aspects of the invention. A pressure side wall part 42 has leading edge keys 44F separated by leading edge keyways 44K, and trailing edge keys 46F separated by trailing edge keyways 46K. A suction side wall part 52 has leading edge keys 54F separated by leading edge keyways 54K, and trailing edge keys 56F separated by trailing edge keyways 56K. The keys of each part 42 and 52 interlock in respective keyways of the opposite part along the leading and trailing edges 22, 24 of the airfoil to form leading and trailing edge joints 18, 19.

Figure 7:
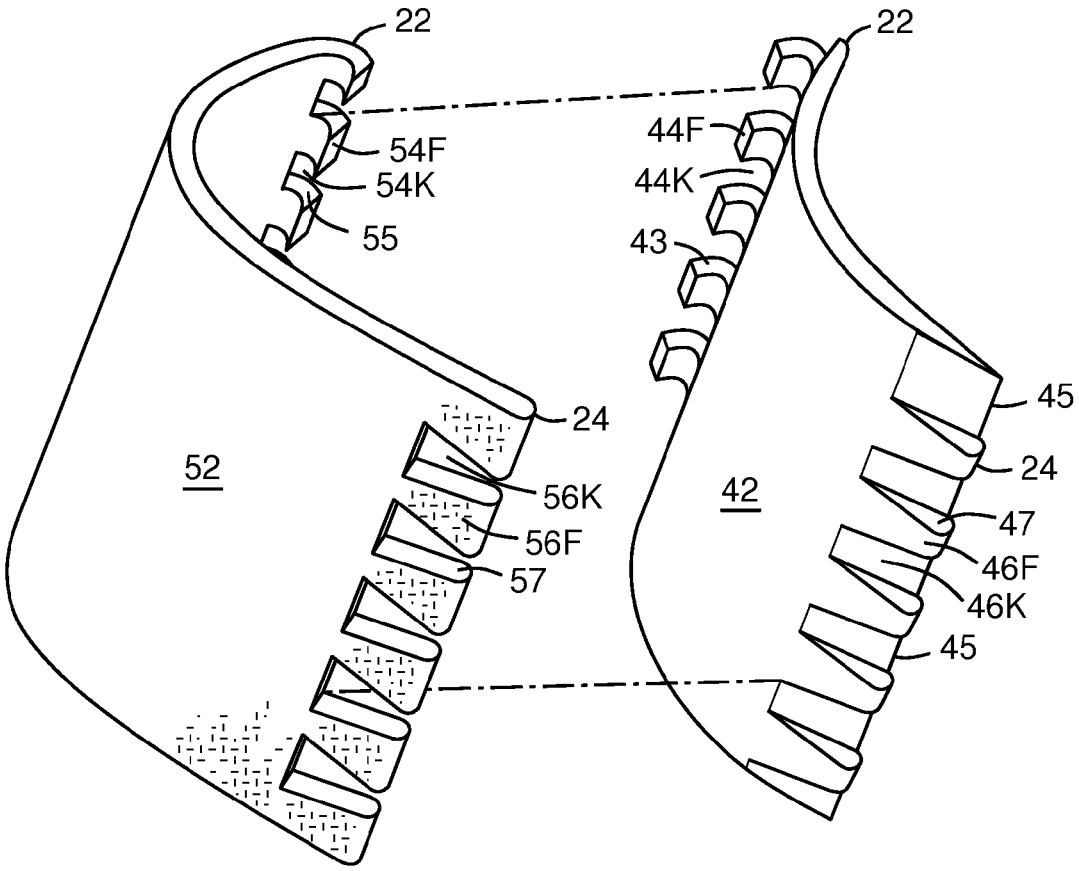
FIG. 7 is an exploded perspective view of a two-part CMC airfoil per the invention.
Figure 10:
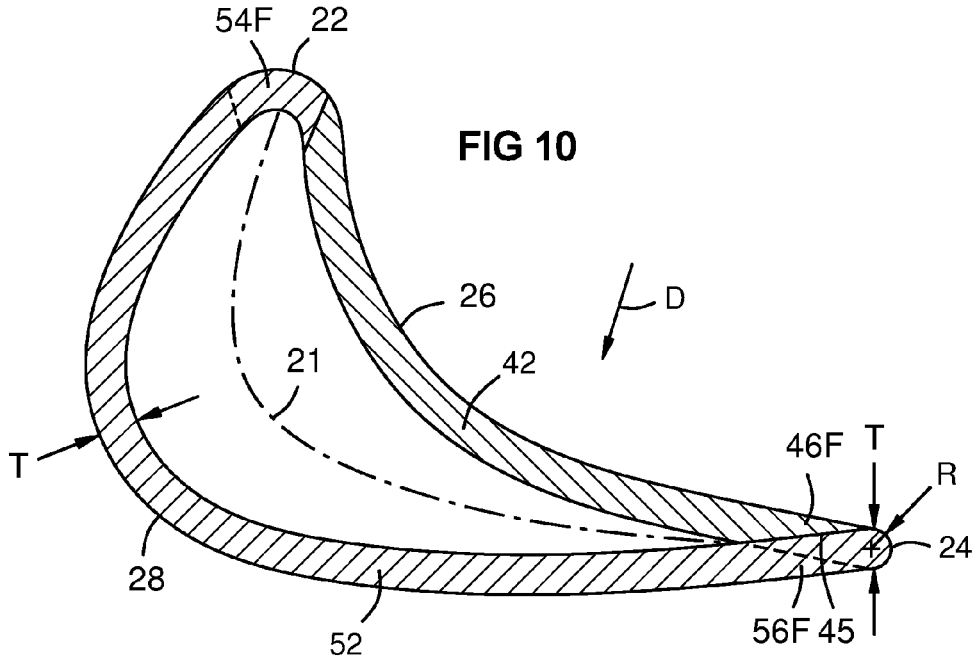
FIG. 10 is a sectional top view taken on a plane through a suction side key of FIG. 8.

The keys have side surfaces 43, 55, 47, 57 that are angled according to the desired joint type and assembly direction. For example, in FIG. 7 the key side surfaces 47 and 57 are angled to provide a dovetail interlock. In FIG. 7 the dot-dash lines connect representative points on the two parts 42, 52 that meet in the assembly shown in FIG. 8. These dot-dash lines indicate one possible assembly direction. However they do not represent a required assembly direction, which is determined by the angles of the side surfaces of the keys. A possible assembly direction D is shown in FIG. 10. In this example, it is approximately tangent to a camber line 21 at the leading edge 22.

Two mechanisms for smoothly merging the pressure and suction side trailing edges are shown in the example embodiment of FIGS. 7-11. The pressure side wall part 42 has feather-edge ramps 45 between the trailing edge keys 46F. Each ramp 45 receives a respective suction side trailing edge key 56F along the ramp such that the final thickness T of the trailing edge equals the thickness of the pressure side wall part. The ramp prevents an indent in the pressure side outer surface that would occur without the ramp.

Figure 11:
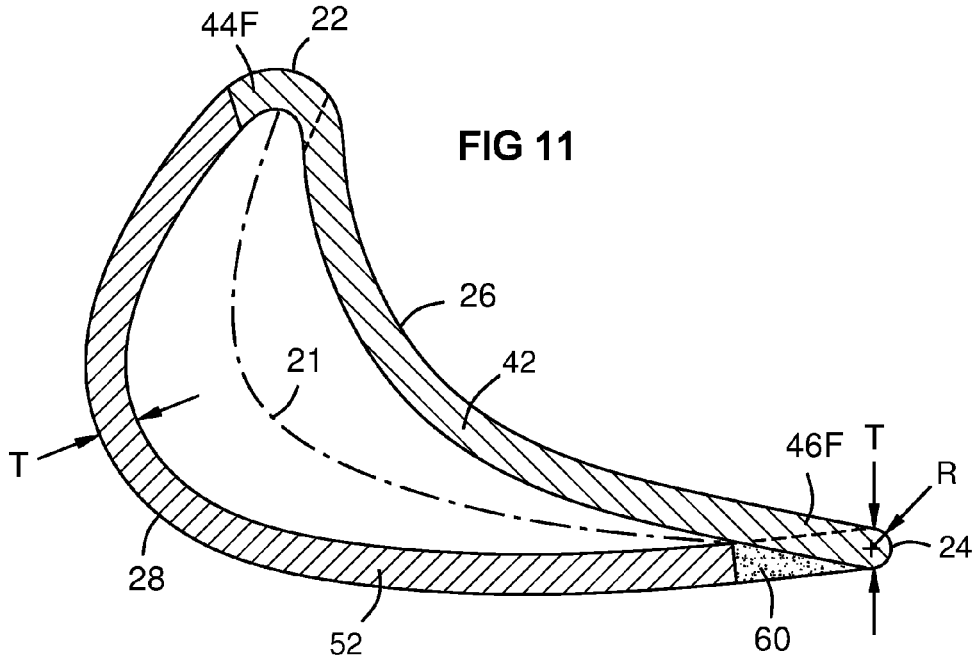
FIG. 11 is a sectional top view taken on a plane through a pressure side key of FIG. 8.

To illustrate an alternative to ramps, the suction side trailing edge keys 56F are separated by keyways 56K without ramps. This results in local indents in the outer surface of the suction side that may be filled with ceramic 60 as shown in FIGS. 8 and 11. This filler material may be a ceramic insulation material as known in gas turbine shroud coatings.

FIG. 10 is a top sectional view through the suction side keys 54F, 56F, showing a ramp 45. FIG. 11 is a top sectional view through the pressure side keys 44F, 46F, showing a filler 60. The distal ends of the pressure and suction side keys 46F, 56F may each have a generally cylindrical radius R of about ½ T, with these radii being coaxial along the trailing edge of the airfoil.

A camber line 21 is a mean curve between the pressure and suction surfaces 26, 28. Assembly direction may be tangent to the camber line at the leading edge 22 as indicated in FIG. 10 or tangent to the camber line 21 at the trailing edge 24, or along the ramps 45, among other directions, depending on the angles of the key sides 43, 55, 47, 57. The embodiment of FIGS. 7-11 can be assembled along a direction D tangent to the camber line 21 at the leading edge 22. This assembly direction happens to be approximately perpendicular to the camber line at the trailing edge 24 in the illustrated airfoil geometry. However, this is not a requirement. The side surfaces 43, 55, 47, 57 of the keys must be angled to allow at least one assembly direction, and they may be angled to allow only one assembly direction by using a dovetail geometry.

Figure 12:
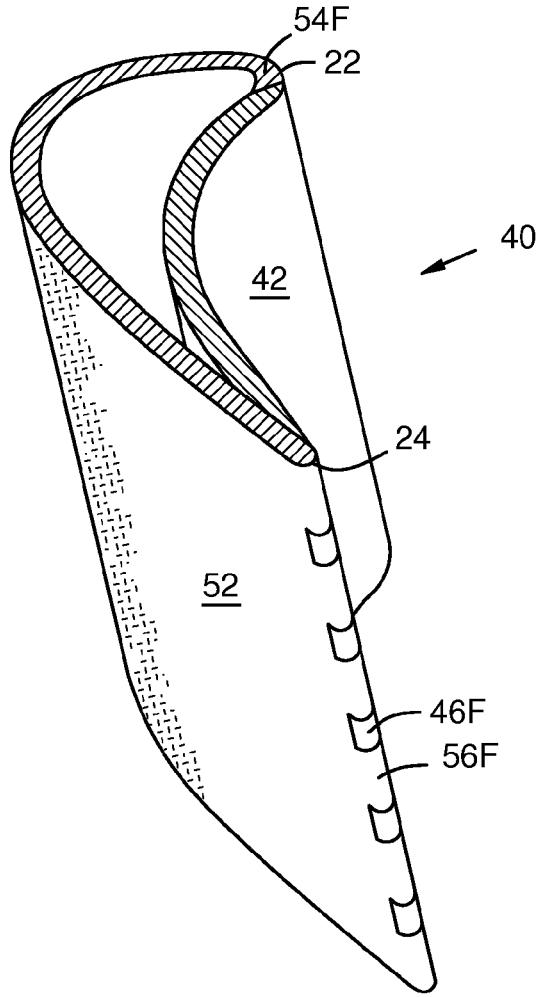
FIG. 12 is perspective rear view of an airfoil with both pressure and suction side trailing edge ramps, eliminating the filler of FIG. 8.
Figure 13:
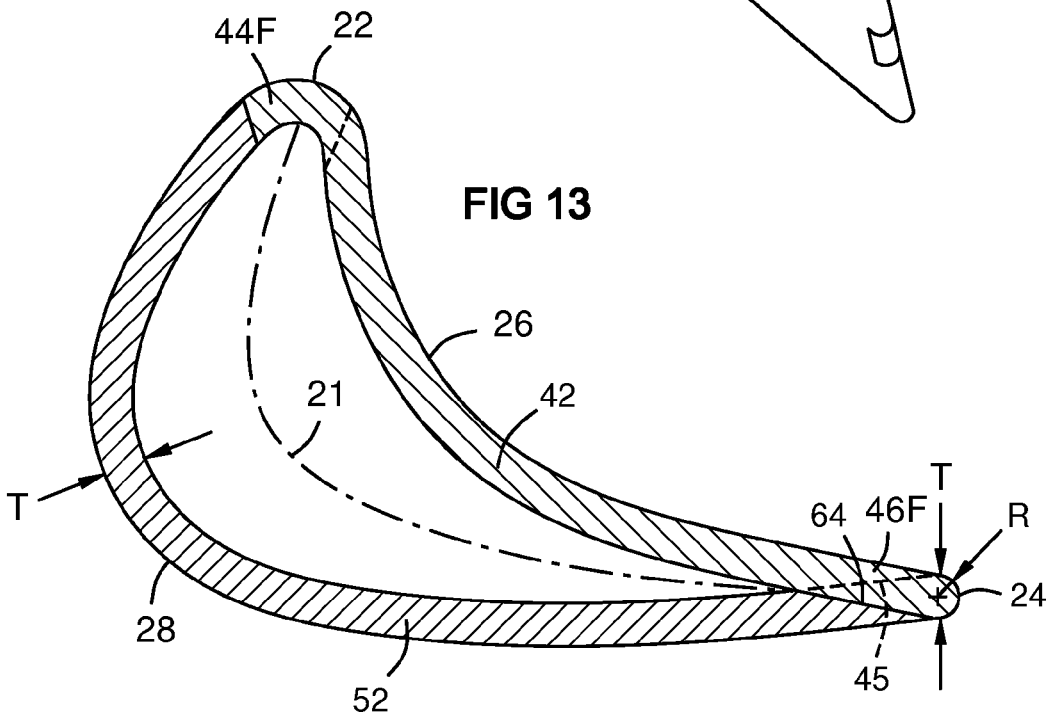
FIG. 13 is a sectional top view taken on a plane through a pressure side key of FIG. 12.

FIG. 12 is perspective rear view of an airfoil with both pressure side trailing edge ramps 45 and suction side trailing edge ramps 64. These ramps eliminate the need for the filler 60 shown in FIGS. 8 and 11. FIG. 13 is a sectional top view taken on a plane through a pressure side key 46F of FIG. 12.

Figure 14:
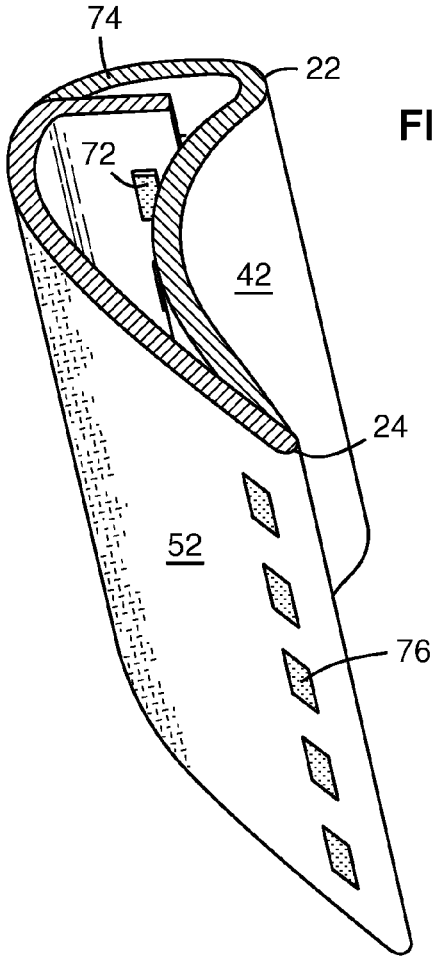
FIG. 14 is perspective rear view of another embodiment of the invention.
Figure 15:
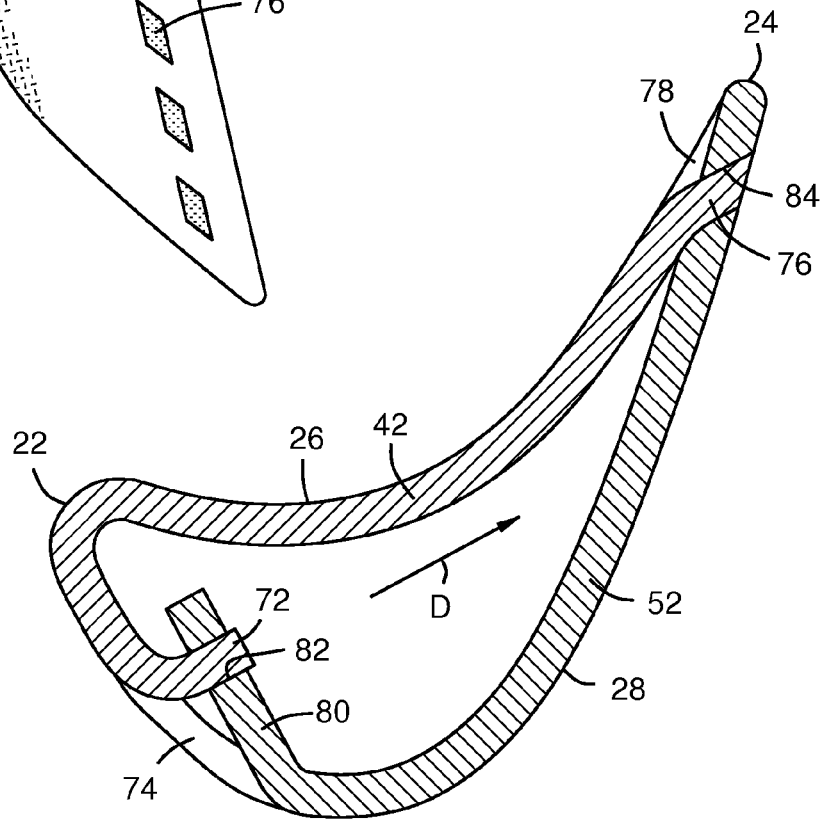
FIG. 15 is a sectional top view taken on a plane through the keys and keyways of FIG. 14.

FIGS. 14-15 illustrate an embodiment in which the leading edge keyways 82 are holes in an inwardly extending flap 80 of the suction side part 52. The trailing edge keyways 84 are holes in the trailing edge of the suction side part 52. The leading edge keys 72 of the pressure side part 42 are inserted into the leading edge keyways 82. The trailing edge keys 76 of the pressure side part 42 are inserted into the trailing edge keyways 84. The leading and trailing edge keyways and keys may be all aligned in substantially the same direction D, allowing assembly in that direction. Surface continuity flaps 74 may be provided between the leading edge keys 72 on the pressure side part 42. Likewise, surface continuity flaps 78 may be provided between the trailing edge keys 76 on the pressure side part 42. Ceramic filler may be applied between the continuity flaps to provide an aerodynamically smooth surface over the joints. Alternately, the continuity flaps may not be provided, and ceramic or CMC filler alone may fill and smooth the indents caused by the joints.

The keys, keyways, and ramps herein may be formed by machining the CMC parts 42, 52 after firing each part. Any indents in the outer surface of the airfoil after assembly can be aerodynamically smoothed by filling with a ceramic filler, such as an insulating ceramic, and/or by applying a thin ceramic fabric or fiber ply overwrap. The airfoil assembly can be fabricated as follows:

1. Lay-up the basic CMC parts 42 and 52
2. Bisque-fire or a fully fire the parts
3. Machine the keys, ramps, tabs per the embodiment
4. Apply ceramic adhesive to the keys, and join the two parts
5. Fill and/or overwrap any indents in the airfoil outer surface
6. Optionally overwrap the joints or the whole airfoil
7. Co-cure the assembly The above description refers to typical oxide-based CMC available commercially (e.g., from COI Ceramics Inc.). Analogies to non-oxide CMCs are evident. For example, parts may be machined at an intermediate stage of matrix densification or pyrolysis, assembled and co-processed through subsequent steps to final density.

Fabrication is simplified from both a tooling and a lay-up perspective because each part is effectively a curved 2D lay-up, rather than a tube. 3D geometric constraints are minimized in each part, resulting in better microstructure properties in the final material. Drying and sintering shrinkages tend to pull apart laminates with constrained shapes, but each airfoil part 42, 52 is less constrained than a layered tube with bends.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A ceramic matrix composite airfoil comprising:

a first side wall comprising a thickness and a first trailing edge with first trailing edge keys;

a second side wall comprising a thickness and a second trailing edge with second trailing edge keyways;

wherein the first and second side walls, when joined, form a hollow airfoil with an airfoil leading edge and an airfoil trailing edge;

wherein the first trailing edge keys interlock into respective second trailing edge keyways to form the airfoil trailing edge; and wherein the airfoil trailing edge tapers to a thickness that is less than a sum of thicknesses of the first and second side walls.

2. The ceramic matrix composite airfoil of claim 1, wherein:

the second side wall comprises second trailing edge keys;

the second trailing edge keyways comprise respective gaps between the second trailing edge keys;

the first side wall comprises first trailing edge keyways comprising respective gaps between the first trailing edge keys; and the second trailing edge keys interlock in respective first trailing edge keyways.

3. The ceramic matrix composite airfoil of claim 1, wherein the first side wall further comprises first leading edge keys and first leading edge keyways, the second side wall further comprises second leading edge keys and second leading edge keyways, and the leading edge keys of each side wall interlock in respective keyways of the other side wall to form the airfoil leading edge.

4. The ceramic matrix composite airfoil of claim 1, wherein the airfoil trailing edge tapers to the thickness of the first or the second side wall.

5. The ceramic matrix composite airfoil of claim 1, wherein the airfoil trailing edge has a generally cylindrical distal surface with an average radius that is approximately half the thickness of the first or the second side wall.

6. The ceramic matrix composite airfoil of claim 1, further comprising a ramp in each second trailing edge keyway, each ramp comprising a proximal end having the thickness of the second side wall and tapering to a distal sharp edge; and wherein the first and second side walls are joined in opposition to each other, and each of the keys follows a ramp from the proximal end to the distal sharp edge thereof.

7. The ceramic matrix composite airfoil of claim 2, wherein the first and second trailing edge keys have side surfaces angled to allow only a single direction of assembly of the first and second trailing edges in interlocking relationship.

8. The ceramic matrix composite airfoil of claim 7, wherein the first and second trailing edge keys have side surfaces that are angled to form a dovetail interlock.

9. The ceramic matrix composite airfoil of claim 1, wherein the second trailing edge keyways are holes through the second trailing edge.

10. The ceramic matrix composite airfoil of claim 9, wherein:

the first side wall comprises a first leading edge with first leading edge keys;

the second side wall comprises a second leading edge with holes through an inward extending flap; and wherein the first and second side walls assemble to form the hollow airfoil by inserting the first leading edge keys into the second leading edge holes and inserting the first trailing edge keys into the second trailing edge holes to form interlocked leading and trailing edge joints of the airfoil.

11. The ceramic matrix composite airfoil of claim 1 wherein the respective first trailing edge keys and second trailing edge keyways are shaped to allow assembly from only a single direction that is approximately tangent to a mean camber line of the airfoil at the leading edge of the airfoil.

12. A ceramic matrix composite airfoil comprising:

a pressure side wall comprising a thickness, a trailing edge, and trailing edge keys;

a suction side wall comprising a thickness, a trailing edge, and trailing edge keys;

wherein the pressure and suction side walls form a hollow airfoil with a leading edge and a trailing edge; and wherein respective trailing edge keys of the two walls interlock to form the trailing edge of the airfoil, which tapers to a thickness less than a combined thicknesses of the two walls, and the airfoil has an aerodynamically smooth outer surface.

13. The ceramic matrix composite airfoil of claim 12, wherein the pressure side wall further comprises leading edge keys, the suction side wall further comprises leading edge keys, and respective leading edge keys of the two walls interlock to form the leading edge of the airfoil.

14. The ceramic matrix composite airfoil of claim 12, wherein the pressure side wall and/or the suction side wall further comprises a ramp between each pair of the trailing edge keys, each ramp comprising a proximal end with the thickness of the respective side wall and tapering to a distal sharp edge; and wherein the pressure and suction side walls are joined in opposition to each other, and each of the trailing edge keys follows one of the ramps of the opposed side wall from the proximal end to the distal sharp edge of the ramp.

15. The ceramic matrix composite airfoil of claim 12, wherein the trailing edge keys have side surfaces angled to allow only a single direction of interlocking assembly of the trailing edge of the airfoil.

16. The ceramic matrix composite airfoil of claim 15, wherein the trailing edge keys have side surfaces that are angled to form a dovetail interlock.

17. The ceramic matrix composite airfoil of claim 12, wherein the respective trailing edge keys of the two walls are shaped to interlock from only a single direction that is approximately tangent to a mean camber line of the airfoil.

18. A ceramic matrix composite airfoil comprising:

a pressure side wall part with leading and trailing edges;

a suction side wall part with leading and trailing edges;

the leading edges of the side wall parts joined by a leading edge interlocking joint;

the trailing edges of the side wall parts joined by a trailing edge interlocking joint;

each interlocking joint comprising a plurality of keys on one of the side wall parts received in mating plurality of respective keyways in the other of the side wall parts;

wherein the a trailing edge of the airfoil is formed by the trailing edge interlocking joint to produce an airfoil trailing edge thickness that is less than a combined wall thickness of the pressure side wall part and the suction side wall part.

19. The ceramic matrix composite airfoil of claim 18 wherein the leading and trailing edge interlocking joints are shaped to only allow assembly from a single direction that is common to both interlocking joints.

20. The ceramic matrix composite airfoil of claim 18 wherein the assembly direction is approximately tangent to a mean camber line of the airfoil at the leading edge of the airfoil.

* * * * *